US005459471A

United States Patent [19]

Thomas

[11] Patent Number: 5,459,471

[45] Date of Patent: Oct. 17, 1995

[54] FLARED TROUGH RADIATOR

[75] Inventor: Mike D. Thomas, Thousand Oaks, Calif.

[73] Assignee: Hughes Aircraft Company, Los Angeles, Calif.

[21] Appl. No.: 174,542

[22] Filed: Dec. 28, 1993

[51] Int. Cl.[6] ..... H01Q 13/06

[52] U.S. Cl. ..... 342/175; 343/786

[58] Field of Search ..... 343/767, 770, 343/771, 772, 776, 786; 333/34, 254; 342/175, 188

[56] References Cited

U.S. PATENT DOCUMENTS 4,409,566 10/1983 Patton et al. ..... 333/26
4,630,062 12/1986 Dewey ..... 343/786
4,636,753 1/1987 Geller et al. ..... 333/26
4,947,181 8/1990 Duncan et al. ..... 343/773
5,126,751 6/1992 Wada et al. ..... 343/789

*Primary Examiner*—Mark Hellner
*Attorney, Agent, or Firm*—Leonard A. Alkov; W. K. Denson-Low

[57] ABSTRACT

A double ridge flared trough radiating element, including a double ridge trough waveguide fed by an embedded coaxial or stripline feed network. Energy couples smoothly to and from the feed network and trough waveguide because the equivalent characteristic impedance at the feed point of the shunt connected waveguide is the same as the feed network characteristic impedance. The radiator can be configured to produce linear, dual-linear or circular polarization.

5 Claims, 4 Drawing Sheets

FLARED TROUGH RADIATOR

FIELD OF THE INVENTION

This invention relates to antenna radiating elements, and more particularly to a flared trough radiator which can operate over a broad frequency spectrum and is arrayable in tight array lattices.

BACKGROUND OF THE INVENTION

There is a continuous effort to make active array radars more compact. Flared notch radiating elements offer wide bandwidth and array ability. However, they require too much depth for low profile applications. Spiral antennas are not arrayable on an electrically tight lattice and are therefore used mostly for interferometer applications.

SUMMARY OF THE INVENTION

The purpose of this invention is to realize an antenna radiating element which can operate over a wide bandwidth, is arrayable in electrically tight lattices, requires very little depth, and is highly producible. Other antenna radiating elements have some of these characteristics. No other has all of them. An important advantage of this invention is that the radiating element has wideband performance, but requires less depth than a flared notch radiator.

A flared trough radiator in accordance with this invention comprises a double ridge flared trough waveguide member. The waveguide member includes a waveguide broadwall, first and second opposed sidewalls extending from the broadwall, and first and second ridges extending respectively from the first and second sidewalls to define a flared trough waveguide cavity. A narrowed gap is defined between opposed edges of the ridges, the edges being flared apart on either side of the gap.

The radiating element further includes a feed network including a feed element such as an embedded suspended stripline or coaxial line which is shunt connected across the flared trough cavity at a feed point for exciting the waveguide member. The characteristic impedance of the feed network is equal to an equivalent characteristic impedance of the waveguide member at the feed point.

The radiating element can be used as a separate element, or in arrays to provide linear, dual linear or other polarizations.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
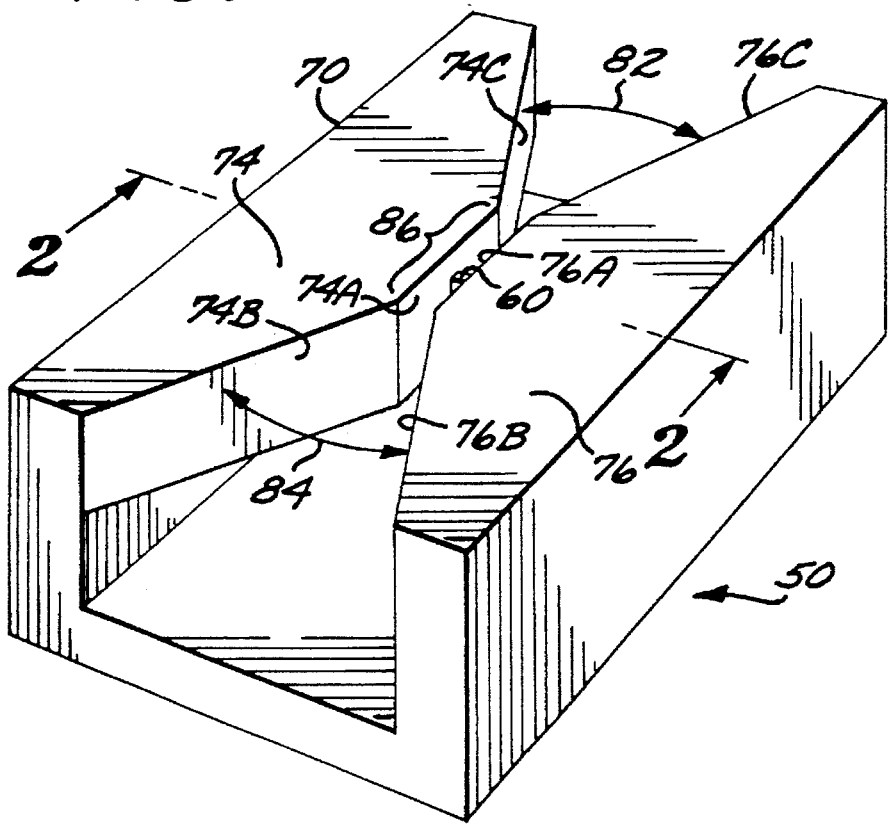
FIG. 1 is an isometric view of a double ridge trough waveguide with an embedded stripline feed in accordance with the invention.
Figure 2:
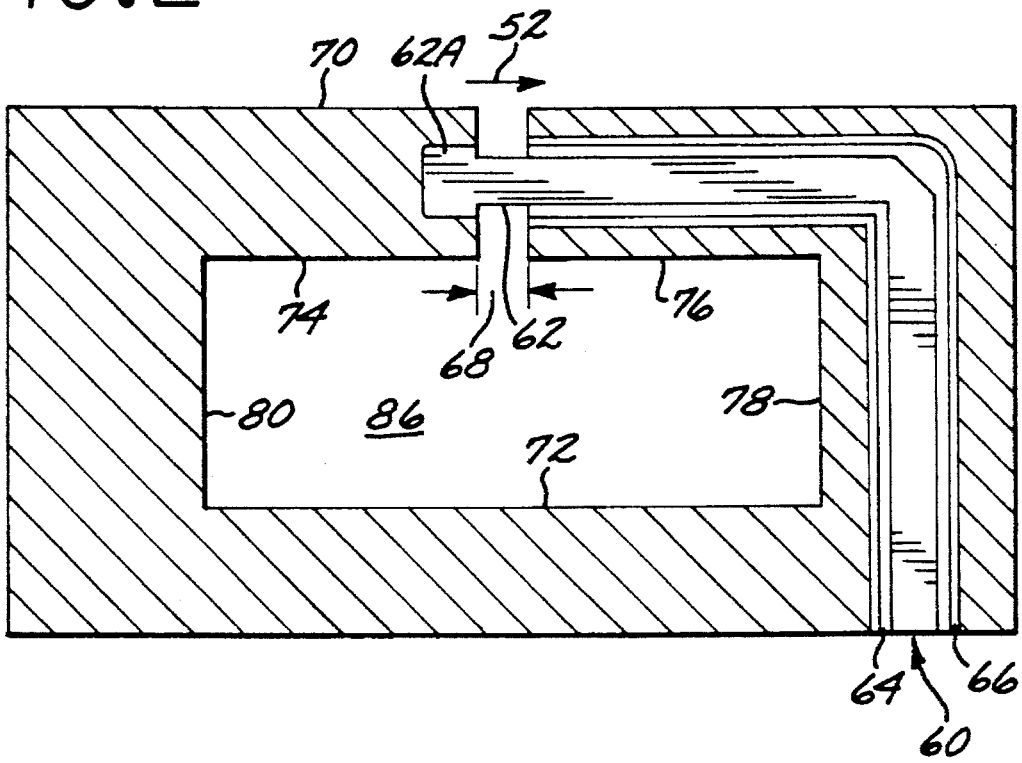
FIG. 2 is a transverse cross-sectional view of the flared trough radiator of FIG. 1, taken along line 2—2 of FIG. 1.

FIGS. 1 and 2 illustrate a preferred embodiment of a radiating element 50 embodying the invention. In this embodiment a stripline feed network 60 is shunt connected across a radiating "double ridge" trough waveguide (DRTW) 70. The DRTW 70 comprises a waveguide broadwall 72, sidewalls 78 and 80, and ridges 74 and 76. The ridges include opposed surfaces 74A and 76B which extend in parallel to define a slot 68 at area 86 between the opposed ends of the radiating element 50. The ridges further have surfaces which are flared on either side of the slot region to form the flared notches of the radiating element. Thus, surfaces 74B and 76B are flared to form a first flared notch 84, and surfaces 74C and 76 C are flared to form a second flared notch 86. In an exemplary embodiment, the flared notches 82 and 84 open from about 0.050 inches to 0.250 inches over a distance of 0.250 inches. Radiators have been built with other degrees of flare, and satisfactory performance has been achieved.

The DRTW 70 defines a cavity 86. The sidewalls 78 and 80, the ridges 74 and 76 and the broadwall 72 all have electrically conductive surfaces, and may be formed of aluminum or a metal-plated plastic material.

The radiating element 50 is fed by a feed network 60 comprising, in this exemplary embodiment, stripline conductor 62 defined on a dielectric substrate 64 suspended within a stripline channel 66 defined in one sidewall 78 and in ridge 76. The conductor 62 therefor follows a right angle turn from the sidewall 78 to the ridge 76. The tip 62A of the conductor 62 is in electrical contact with the conductive surface of ridge 74; however, the channel 66 and dielectric substrate 64 serve to keep the conductor 60 from contacting the conductive surface of ridge 76.

Alternatively, the feed network 60 could include another type of transmission circuit in place of the stripline. For example, a coaxial line could be employed, wherein the channel 66 is replaced with an open bore, with a coaxial center conductor replacing the stripline center conductor 62, being supported and spaced within the bore by dielectric spacer material. The tip of the coaxial center conductor would be connected to the opposed ridge, as is the tip of the stripline conductor.

Energy couples smoothly to and from stripline feed circuit 60 to the DRTW 70 because the equivalent characteristic impedance at the feed point of the shunt connected DRTW is the same as that of the stripline. The feed point is the area defined by surfaces 74A and 76A. By changing the size of these surfaces and the distance between the surfaces, the characteristic impedance of the feed point is changed. The electric field is oriented across the slot 62, as illustrated by arrow 52. The DRTW has the same basic operating characteristics as double ridge waveguide except it is an open structure. Therefore, it is naturally a leaky wave transmission line very similar to slotline or conventional trough waveguide when its resonant frequency is well below the operating frequency, and it is in a transmission line mode.

Figure 3:
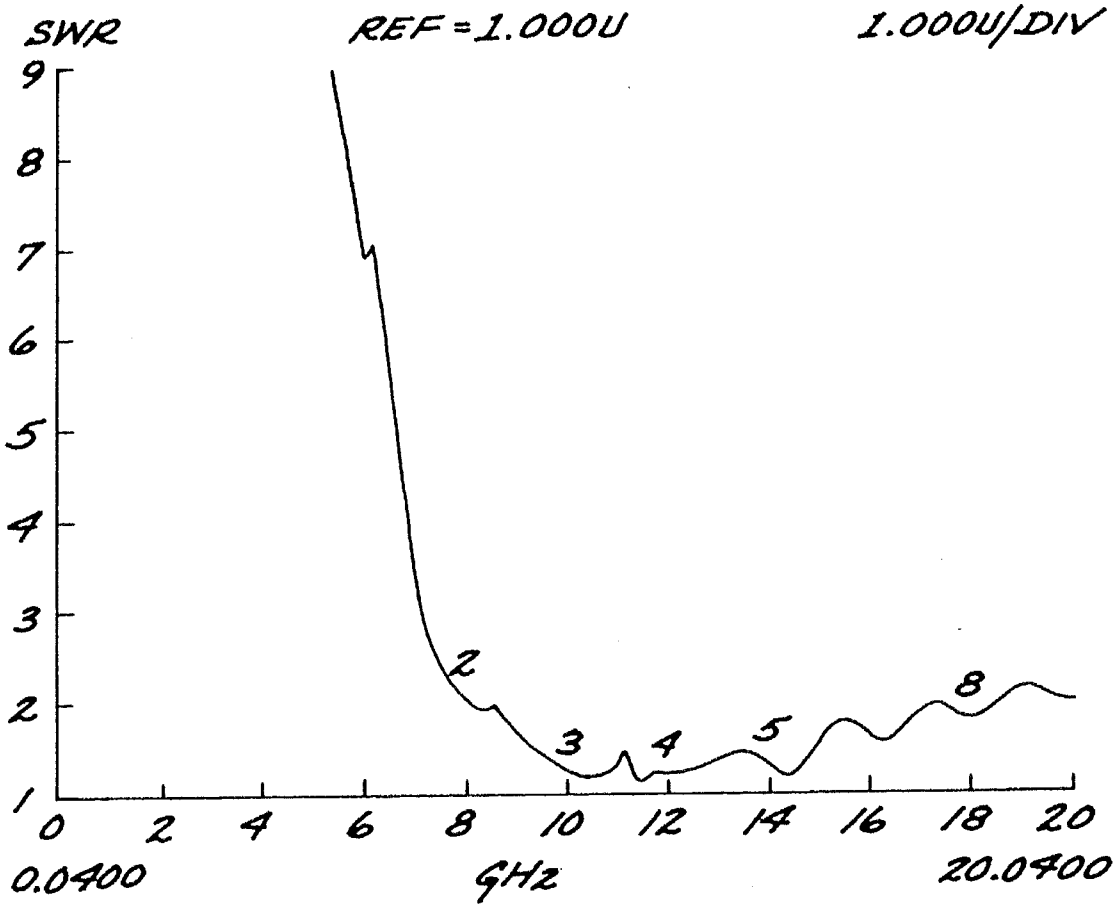
FIG. 3 is a graph illustrating measured VSWR for an exemplary embodiment of a flared trough radiator in accordance with the invention.

A linearly polarized flared trough radiator which measures 0.633 inches long by 0.510 wide and 0.250 deep has been fabricated. The radiator demonstrated input VSWR less than 2:1 from 8 to 20 GHz as shown in FIG. 3. Radiation patterns were also excellent, exhibiting cosine (theta) type shape.

Figure 4:
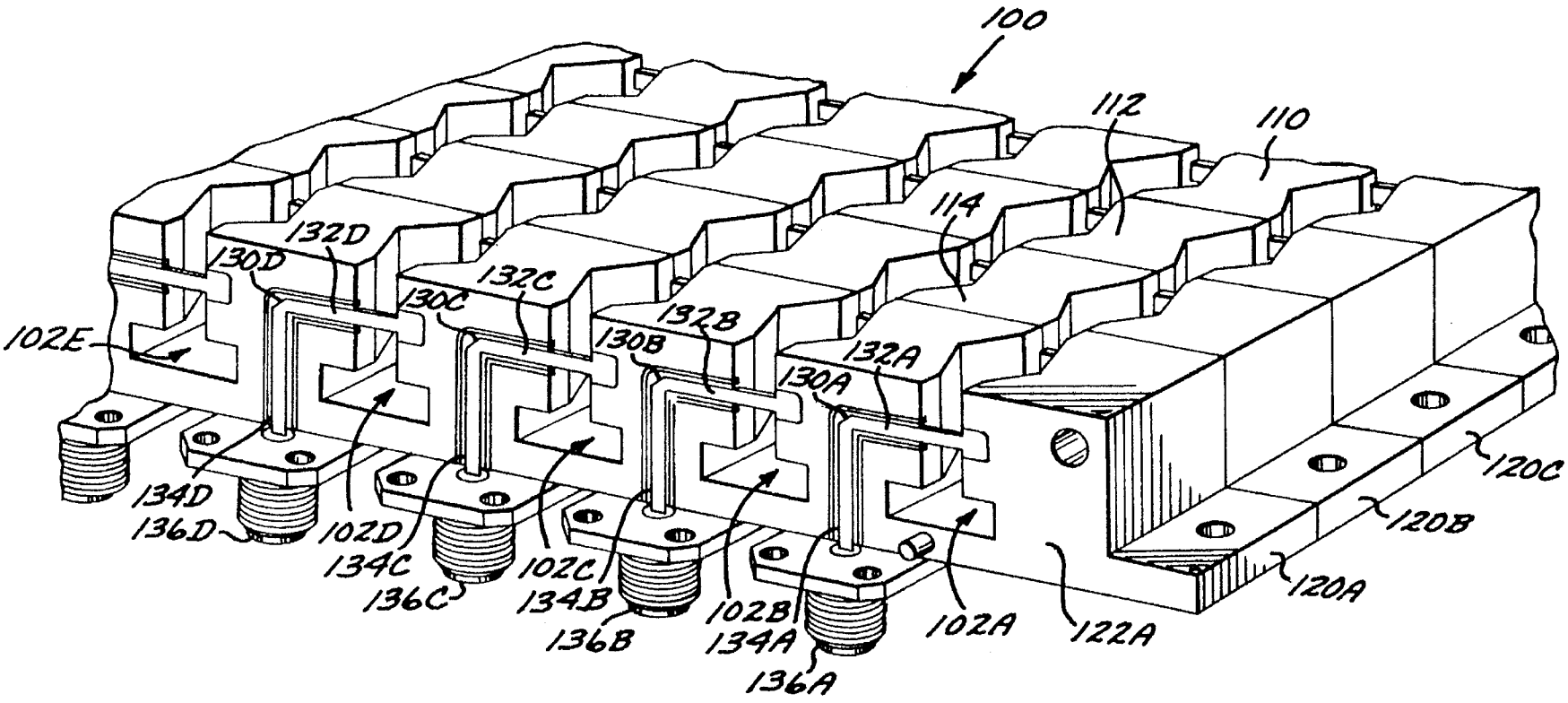
FIG. 4 illustrates a planar array of double ridge trough waveguide radiating elements in accordance with the invention.
Figure 5:
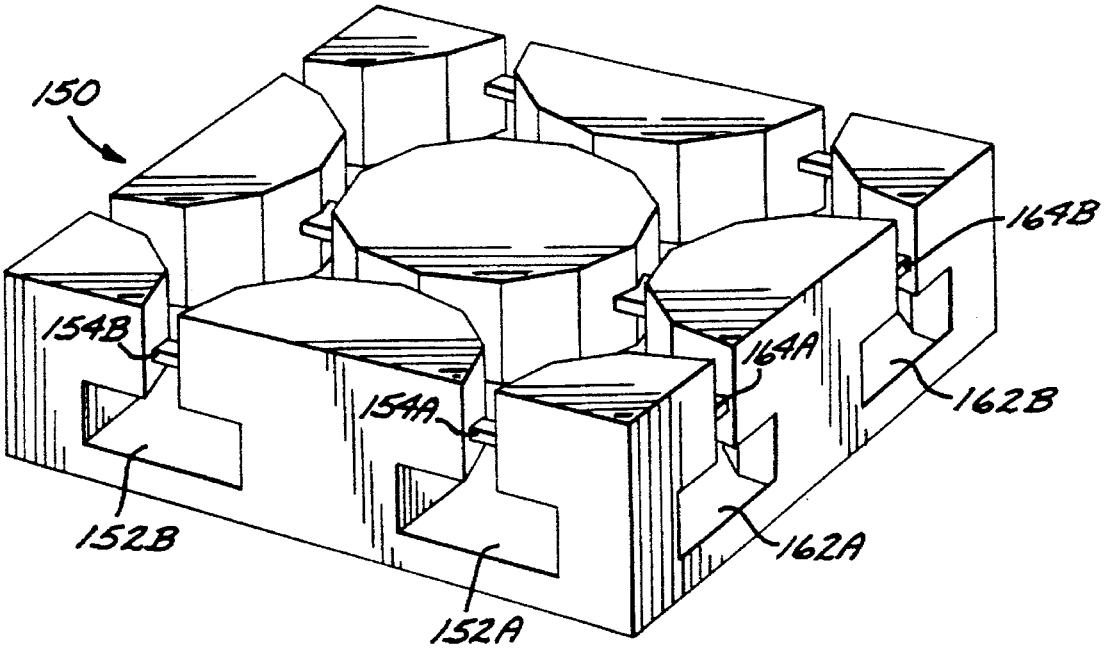
FIG. 5 illustrates an exemplary section from an orthogonal array of linearly polarized flared trough radiators to achieve dual-linear polarization.

FIG. 4 illustrates a portion of a planar array 100 comprising many of the radiating elements as shown in FIG. 1 and FIG. 2. The elements are set up in aligned rows, each element in a row arranged along a waveguide cavity. Thus, for example, waveguide cavity 102A in FIG. 5 is defined by an aligned plurality of elements 110, 112 and 114, each element similar to element 50 of FIG. 1. The portion of the array 100 in FIG. 1 further has a plurality of other waveguide cavities 102B-E arranged in parallel with cavity 102A, each defined by an aligned plurality of radiating elements of the type shown in FIG. 1.

The array illustrated in FIG. 5 is constructed using module sections 120A, 120B, 120C . . . which define the broadwalls, sidewalls and ridges of the waveguide elements comprising the radiating elements. The module sections further have defined therein along surfaces thereof the channels in which the stripline feed networks are suspended. Thus, module section 120A has formed in surface 122A channels 130A–130D. Within each channel, a stripline conductor element 132A–E is suspended on a corresponding dielectric substrate 134A–E. The stripline conductors are brought out to coaxial connectors 136A–D to provide a connection for the input drive signals. Fabricating the array in this manner using the module sections provides ready assembly of the embedded feed networks.

Figure 6:
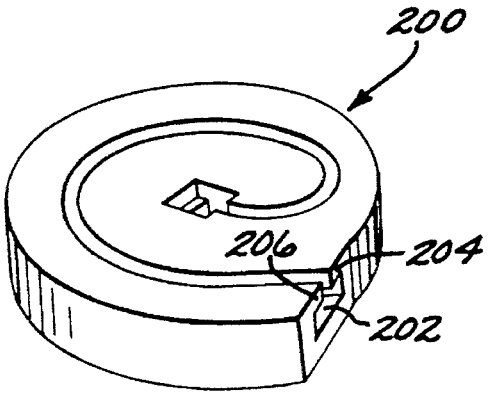
FIG. 6 illustrates a radially spirally double ridge trough waveguide to achieve circular polarization.

The flared trough radiator can be configured in a variety of geometries to produce linear, dual-linear, or circular polarization. Dual-linear polarization can be effected with orthogonal arrays of linearly polarized flared trough radiators, as shown in FIG. 5. Here, a section 150 of the dual polarized array is formed by double ridge trough waveguide structures arranged to define orthogonal waveguide cavities 152A, 152B and 162A, 162B, with embedded feed networks 1254A, 154B and 164A, 164B. Circular polarization can be effected with one element 200 as shown in FIG. 6, wherein the waveguide cavity 202 and the ridges 204 and 206 define a spiral trough.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A flared trough radiator operable at microwave frequencies, comprising:

a double ridge flared trough waveguide member, comprising a waveguide broadwall, first and second opposed sidewalls extending from said broadwall, and first and second ridges extending respectively from said first and second sidewalls to define a trough waveguide cavity, and wherein a narrowed gap is defined between opposed edges of said ridges, said edges being flared apart on either side of said gap to define respective first and second flared troughs and further wherein said sidewalls and said ridges are arranged to define a spiral trough, and said radiating element produces circularly polarized radiation.

2. The radiating element of claim 1 wherein said feed network has a feed characteristic impedance, and wherein said waveguide member is characterized by an equivalent characteristic impedance at said feed point, and said equivalent impedance is substantially equal to said feed characteristic impedance.

3. The radiating element of claim 1 wherein said feed element comprises a suspended stripline conductor extending transversely across said feed point, said conductor suspended within a channel defined within said first ridge and having a conductor end which is electrically connected to said second ridge.

4. The radiating element of claim 3 wherein said suspended stripline conductor comprises a conductor portion which is embedded within said first ridge and within said first sidewall.

5. An array of flared trough radiating elements, comprising:

a plurality of flared trough radiating elements arranged in aligned rows, each radiating element comprising:

a double ridge flared trough waveguide member, comprising a waveguide broadwall, first and second opposed sidewalls extending from said broadwall, and first and second ridges extending respectively from said first and second sidewalls to define a trough waveguide cavity, and wherein a narrowed gap is defined between opposed edges of said ridges, said edges being flared apart on either side of said gap to define respective first and second flared troughs; and a feed network having a feed element which is shunt connected across said gap at a feed point for exciting said waveguide member, wherein said feed network comprises suspended stripline networks embedded within said waveguide members and further wherein said feed network comprises a suspended stripline conductor extending transversely across said feed point, said conductor suspended within a channel defined within said first ridge pad having a conductor end which is electrically connected to said second ridge;

wherein said radiating elements comprising a row of elements are aligned, the waveguide cavities of each said element of the row all in communication, and wherein said array comprises a plurality of module sections which are fitted together at parting lines defined along said aligned ones of said stripline channels.

* * * * *